US010465682B2

(12) United States Patent
Yang et al.

(10) Patent No.: US 10,465,682 B2
(45) Date of Patent: Nov. 5, 2019

(54) ROTARY COMPRESSOR AND REFRIGERATION CYCLE DEVICE HAVING SAME

(71) Applicant: Guangdong Meizhi Compressor Co., Ltd., Foshan (CN)

(72) Inventors: Guoyong Yang, Foshan (CN); Weimin Xiang, Foshan (CN); Yongjun Fu, Foshan (CN)

(73) Assignee: GUANGDONG MEIZHI COMPRESSOR CO., LTD., Foshan (CN)

( * ) Notice: Subject to any disclaimer, the term of this patent is extended or adjusted under 35 U.S.C. 154(b) by 216 days.

(21) Appl. No.: 15/503,494

(22) PCT Filed: Aug. 24, 2015

(86) PCT No.: PCT/CN2015/087931
§ 371 (c)(1),
(2) Date: Feb. 13, 2017

(87) PCT Pub. No.: WO2017/031669
PCT Pub. Date: Mar. 2, 2017

(65) Prior Publication Data

US 2018/0156215 A1 Jun. 7, 2018

(51) Int. Cl.
*F04C 29/12* (2006.01)
*F04C 28/00* (2006.01)
(Continued)

(52) U.S. Cl.
CPC ..... *F04C 18/34* (2013.01); *F04C 18/3564* (2013.01); *F04C 23/001* (2013.01);
(Continued)

(58) Field of Classification Search
CPC ..... F04C 18/34; F04C 18/356; F04C 28/00; F04C 29/12; F04C 29/04; F04C 29/0042
See application file for complete search history.

(56) References Cited

U.S. PATENT DOCUMENTS 6,796,773 B1 * 9/2004 Choi ..... F04C 18/3562 417/218
7,290,994 B2 * 11/2007 Kitaichi ..... F01C 21/007 418/11
(Continued)

FOREIGN PATENT DOCUMENTS

CN 101397998 A 4/2009
CN 202117924 U 1/2012
(Continued)

OTHER PUBLICATIONS

Chinese Patent Application No. 201510528200.9 Office Action dated Mar. 13, 2017, 5 pages.
(Continued)

*Primary Examiner* — Deming Wan
(74) *Attorney, Agent, or Firm* — Scully Scott Murphy & Presser

(57) ABSTRACT

A rotary compressor (700) and a refrigeration cycle device (1000) having same are provided. The rotary compressor comprises: a liquid reservoir (1), a first direction control assembly (49), and a compression mechanism. The compression mechanism comprises two cylinders and two gas injection holes, in which a sliding vane of one cylinder is pressed against an outer circumferential wall of a piston in the cylinder and a gas injection hole is used for injecting a refrigerant to the cylinder, while the sliding vane of the other cylinder is optionally in contact with or separate from the piston in the cylinder, the other gas injection hole is used for unidirectionally injecting the refrigerant into the cylinder; a first valve port (491) of the first direction control assembly
(Continued)

(49) is connected to the gas suction port of the other cylinder, a second valve port (492) thereof is connected to liquid reservoir (1), a third valve port (493) thereof is in communication with the exhaust hole, and the second valve port (492) and the third port (493) are optionally in communication with the first valve port (491).

18 Claims, 7 Drawing Sheets

(51) Int. Cl.

| | |
|---|---|
| ***F04C 18/34*** | (2006.01) |
| ***F04C 23/00*** | (2006.01) |
| ***F04C 29/04*** | (2006.01) |
| ***F04C 28/06*** | (2006.01) |
| ***F04C 28/26*** | (2006.01) |
| ***F04C 29/00*** | (2006.01) |
| ***F04C 18/356*** | (2006.01) |

(52) U.S. Cl.
CPC ..... *F04C 23/008* (2013.01); *F04C 28/00* (2013.01); *F04C 28/065* (2013.01); *F04C 28/26* (2013.01); *F04C 29/0007* (2013.01); *F04C 29/12* (2013.01); *F04C 2240/30* (2013.01); *F04C 2240/50* (2013.01)

(56) References Cited

U.S. PATENT DOCUMENTS

| | | | | |
|---|---|---|---|---|
| 7,607,902 | B2 * | 10/2009 | Onoda | F01C 21/0863 417/218 |
| 8,225,624 | B2 * | 7/2012 | Yamaguchi | F04C 18/02 62/175 |
| 2011/0023535 | A1 * | 2/2011 | Morimoto | C09K 5/045 62/510 |
| 2014/0099218 | A1 * | 4/2014 | Hiwata | F04C 29/12 417/410.3 |
| 2017/0108246 | A1 * | 4/2017 | Xiang | F04C 23/008 |

FOREIGN PATENT DOCUMENTS

| | | | |
|---|---|---|---|
| CN | 102364107 | A | 2/2012 |
| CN | 202301033 | U | 7/2012 |
| CN | 103161729 | A | 6/2013 |
| CN | 105065273 | A | 11/2015 |
| CN | 204941944 | U | 1/2016 |
| EP | 1 605 167 | A1 | 12/2005 |
| JP | H04203489 | A | 7/1992 |
| JP | H07127575 | A | 5/1995 |
| JP | 2005344683 | A | 12/2005 |
| JP | 2009203861 | A | 9/2009 |
| JP | 5760836 | B2 | 8/2015 |
| WO | WO 2013122363 | A1 | 8/2013 |

OTHER PUBLICATIONS

Chinese Patent Application No. 201510528200.9 First Office Action dated Oct. 8, 2016, 8 pages.
Chinese Patent Application No. 201510528200.9 English translation of First Office Action dated Oct. 8, 2016, 11 pages.
PCT/CN2015/087931 English translation of International Search Report dated May 25, 2016, 2 pages.
Japanese Patent Application No. 2017515828, Office Action dated Jan. 9, 2018, 3 pages.
Japanese Patent Application No. 2017515828, English translation of Office Action dated Jan. 9, 2018, 3 pages.
Extended European Search Report dated Mar. 11, 2019 received in European Patent Application No. EP 15901940.5.

* cited by examiner

ROTARY COMPRESSOR AND REFRIGERATION CYCLE DEVICE HAVING SAME

CROSS-REFERENCE TO RELATED APPLICATION

The present application is a national phase entry under 35 USC § 371 of International Application PCT/CN2015/087931, filed on Aug. 24, 2014, the entire disclosure of which is incorporated herein by reference.

FIELD

The present disclosure relates to a compressor device, and more particularly to a rotary compressor and a refrigeration cycle device having the same.

BACKGROUND

The related technologies indicate that in some applications, for example, in heat pump application in low temperature environment, the decrease of the evaporating temperature will lead to the reduce of the capacity of a refrigeration cycle system, and the performance of an ordinary single-stage rotary compressor becomes too worse to use. If a solution of large-capacity enhanced vapor injection is adopted, the capacity of the refrigeration cycle system can be improved effectively, but an ordinary high displacement double-cylinder enhanced vapor injection rotary compressor still performs a double-cylinder operation in case of a small compression load, which makes the running efficiency worse.

SUMMARY

Embodiments of the present disclosure seek to solve at least one of the problems existing in the related art to at least some extent. Therefore, the present disclosure aims to provide a rotary compressor that has advantages of a simple and reasonable structure, a high operating efficiency, a wide range of application, and an excellent low temperature heating effect.

The present disclosure further provides a refrigeration cycle device comprising the above-identified rotary compressor.

According to a first aspect of the present disclosure, the rotary compressor comprises: a liquid reservoir; a housing disposed outside the liquid reservoir, in which an exhaust port is formed; a compression mechanism disposed within the housing; and a first direction control assembly comprising a first valve port connected to said another cylinder, a second valve port connected to the liquid reservoir, and a third valve port in communication with the exhaust hole, one of the second valve port and the third port being in communication with the first valve port. The compression mechanism comprises a main bearing, a cylinder assembly, an auxiliary bearing, two pistons and two sliding vanes, wherein the main bearing and the auxiliary bearing are disposed at both axial ends of the cylinder assembly respectively; the cylinder assembly comprises two cylinders having compression chambers, and a partition plate arranged between the two cylinders, on each of which a sliding vane groove, a gas suction hole and an exhaust hole are formed; each piston is disposed inside the corresponding compression chamber and capable of rolling along an inner wall of the compression chamber; each sliding vane is movably disposed inside the corresponding sliding vane groove, a head portion of the sliding vane of one of the two cylinders abutting against an outer circumferential wall of the corresponding piston, while the sliding vane of the other one of the two cylinders being optionally in contact with or separate from the corresponding piston. The compressor mechanism is provided with a first gas injection hole for injecting a refrigerant into the compression chamber of the one of the cylinder, and a second gas injection hole for unidirectionally injecting the refrigerant into the compression chamber of another cylinder.

The rotary compressor according to the present disclosure has the advantages of the high operating efficiency, wide application range, and excellent low temperature heating effect.

In addition, the rotary compressor according to the above embodiment of the present disclosure can also have the additional technological features.

According to an embodiment of the present disclosure, the first gas injection hole and the second gas injection hole are formed in the partition plate.

According to an embodiment of the present disclosure, the first gas injection hole and the second gas injection hole are formed in the main bearing and the auxiliary bearing respectively.

According to an embodiment of the present disclosure, the second gas injection hole is located at a side of the first gas injection hole adjacent to the exhaust port in the rolling direction of the piston.

According to an embodiment of the present disclosure, the rotary compressor further comprises a one-way valve, disposed at the second gas injection hole and configured to unidirectionally inject the refrigerant into the compression chamber of said another cylinder.

According to an embodiment of the present disclosure, a tail portion of the sliding vane of the said another cylinder is provided with a sliding braking device; when the pressure difference between the tail portion of the sliding vane and the head portion of the sliding vane is greater than a braking force acted on the sliding vane by the sliding vane braking device, the sliding vane is separated from the sliding vane braking device, and the head portion of the sliding vane is pressed against the outer circumferential wall of the corresponding piston.

According to an embodiment of the present disclosure, the braking force is from 2N to 10N.

According to an embodiment of the present disclosure, the third valve port is directly connected to the exhaust port or an interior of the housing.

According to an embodiment of the present disclosure, the first direction control assembly is a three-way valve.

According to a second aspect of the present disclosure, the refrigeration cycle device comprises the rotary compressor according to embodiments of the first aspect of the present disclosure; a second direction control assembly comprising a first connector, a second connector, a third connector and a fourth connector, the first connector being connected to the exhaust port of the rotary compressor and the fourth connector being connected to the liquid reservoir; an outdoor heat exchanger having a first end connected to the second connector; an indoor heat exchanger having a first end connected to the third connector and a second end connected to a second end of the outdoor exchanger; and a flash tank connected between the second end of the indoor exchanger and the second end of the outdoor exchanger, wherein the flash tank is connected to the first gas injection hole and the second gas injection hole of the rotary compressor.

For the refrigeration cycle device according to the present disclosure, by providing the rotary compressor according to embodiment of the first aspect of the present disclosure, the overall performance of the refrigeration cycle device may be improved.

Additional aspects and advantages of embodiments of present disclosure will be given in part in the following descriptions, become apparent in part from the following descriptions, or be learned from the practice of embodiments of the present disclosure.

REFERENCE NUMERALS

Figure 1:
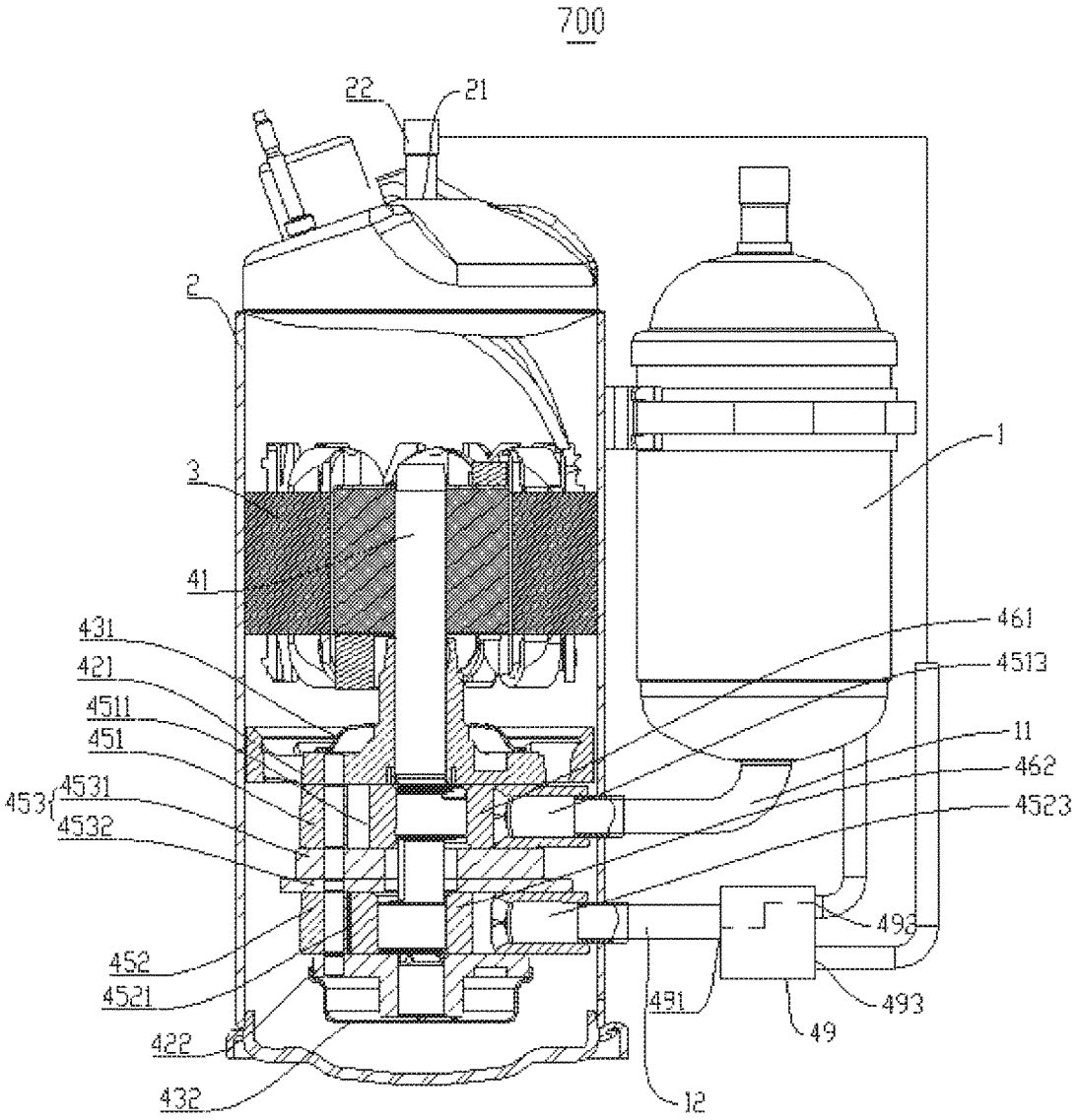
FIG. 1 shows a sectional view of a rotary compressor from one perspective according to an embodiment of the present disclosure.

1000: refrigeration cycle device
- 100: second direction control assembly;
  - 101: first connector;
  - 102: second connector;
  - 103: third connector;
  - 104: fourth connector;
- 200: outdoor heat exchanger;
- 300: indoor heat exchanger;
- 400: flash tank;
- 500: first throttling member;
- 600: second throttling member;
- 700: rotary compressor;
  - 1: liquid reservoir;
  - 11: first gas suction pipe;
  - 12: second gas suction pipe;
  - 2: housing:
  - 21: exhaust port;
  - 22: exhaust pipe;
  - 3: motor;
    - 41: crankshaft;
    - 421: main bearing;
    - 4211: first exhaust valve;
    - 422: auxiliary bearing;
    - 4221: second exhaust valve;
    - 431: first muffler;
    - 432: second muffler;
    - 44: gas injection pipe;
    - 441: first gas injection hole;
    - 442: second gas injection hole;
    - 443: one-way valve;
      - 451: first cylinder;
      - 4511: first compression chamber;
      - 4512: first sliding vane groove;
      - 4513: first gas suction hole;
      - 4514: first exhaust hole;
      - 452: second cylinder;
      - 4521: second compression chamber;
      - 4522: second sliding vane groove;
      - 4523: second gas suction hole;
      - 4524: second exhaust hole;
      - 453: partition plate;
      - 4531: first partition plate;
      - 4532: second partition plate;
    - 461: first piston;
    - 462: second piston;
    - 471: first sliding vane;
    - 472: second sliding vane;
    - 481: spring;
    - 482: sliding vane braking device;
  - 49: first direction control assembly;
  - 491: first valve port;
  - 492: second valve port;
  - 493: third valve port.

DETAILED DESCRIPTION

Embodiments of the present invention will be described in detail and examples of the embodiments will be illustrated in the drawings, in which same or similar reference numerals are used to indicate same or similar members or members with same or similar functions throughout the specification. The embodiments described herein with reference to drawings are explanatory, which are used to illustrate the present invention, but shall not be construed to limit the present disclosure.

Various embodiments and examples are provided in the following description to implement different structures of the present disclosure. In order to simplify the present disclosure, certain elements and settings will be described. However, these elements and settings are only by way of example and are not intended to limit the present disclosure. In addition, reference numerals and/or letters may be repeated in different examples in the present disclosure. This repeating is for the purpose of simplification and clarity and does not refer to relations between different embodiments and/or settings. Furthermore, examples of different processes and materials are provided in the present disclosure. However, it would be appreciated by those skilled in the art that other processes and/or materials may be also applied.

A rotary compressor 700 according to embodiments of the first aspect of the present disclosure will be described below with reference to FIGS. 1-6.

As shown in FIG. 1, the rotary compressor 700 includes: a liquid reservoir 1, a housing 2, a compression mechanism, and a first direction control assembly 49.

Specifically, the housing 2 is disposed outside the liquid reservoir 1 and formed with an exhaust port 21 therein. According to FIG. 1, the rotary compressor 700 can be a vertical compressor, and hereby, the housing 2 can be substantially formed as a hollow and sealed cylindrical tube shape, with a central axis thereof extending in the vertical direction; the exhaust port 21 can penetrate a top wall of the housing 2 in an up-and-down direction, and an vertically extended exhaust pipe 22 can be inserted into the exhaust port 21 to discharge a gaseous refrigerant (or a mixture with part of liquid refrigerant and lubricating oil) from the interior of the housing 2; the liquid reservoir 1 is disposed outside the housing 2. Of course, the present invention is not limited thereto, i.e. the rotary compressor 700 can be a horizontal compressor, and hereby, the central axis of the housing 2 can extend in the horizontal direction. Only the rotary compressor 700 configured as the vertical compressor will be exemplified below.

Specifically, the compression mechanism is disposed within the housing 2, and includes a cylinder assembly, a main bearing 421 and an auxiliary bearing 422 disposed separately at both axial ends of the cylinder assembly. For example, as shown in FIG. 1, the main bearing 421 is disposed at the top of the cylinder assembly, while the auxiliary bearing 422 is disposed at the bottom of the cylinder assembly.

Figure 2:
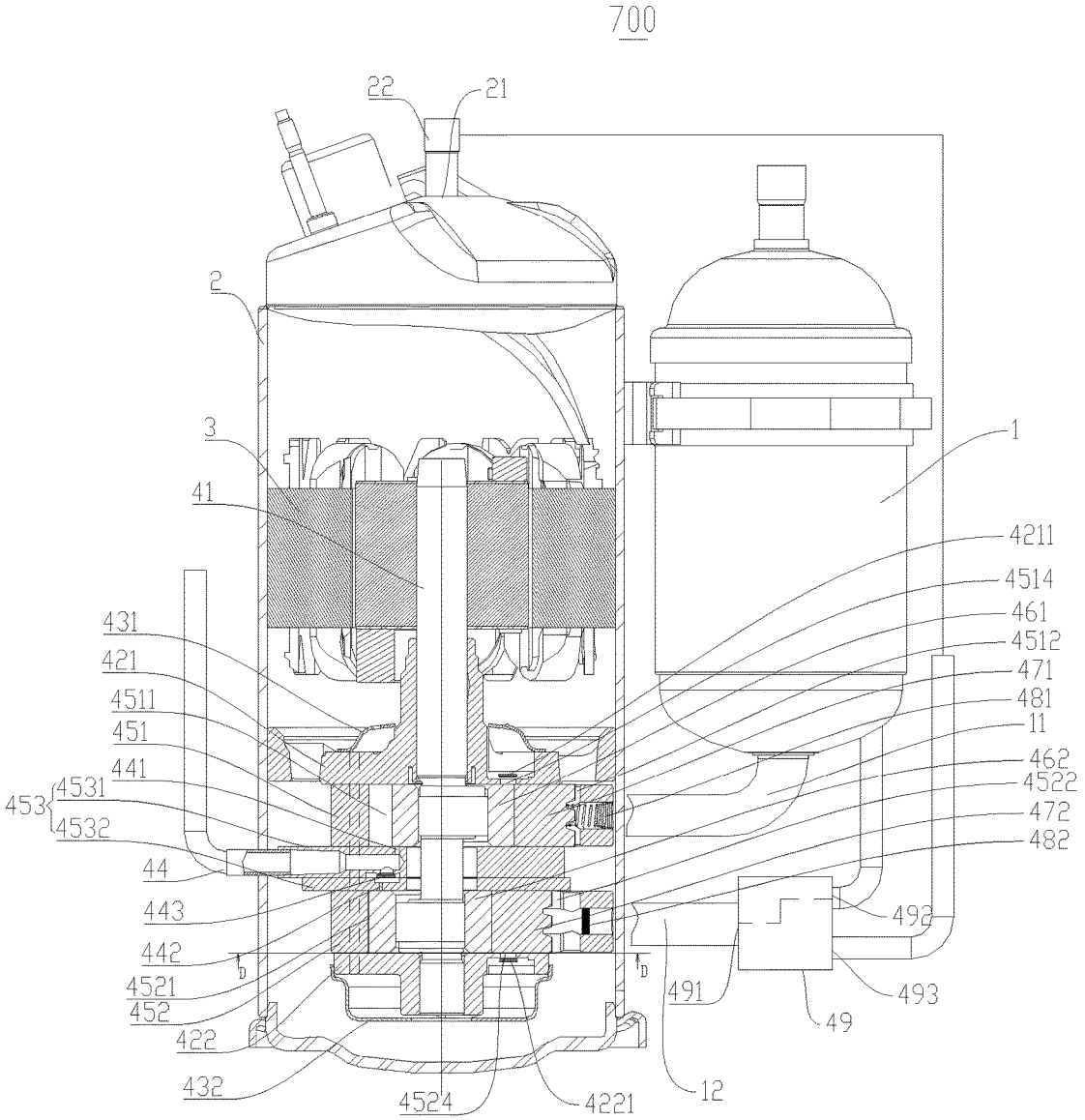
FIG. 2 shows a sectional view of the rotary compressor of FIG. 1 from another perspective, wherein a first valve port of a first direction control assembly is in communication with a second valve port thereof.

Further, the cylinder assembly comprises two cylinders provided with compression chambers, and a partition plate 453 arranged between the two cylinders. That is, the cylinder assembly includes two cylinders, the partition plate 453 is arranged between the two cylinders, and each of the two cylinders has a compression chamber. As shown in FIGS. 1 and 2, the cylinder assembly includes a first cylinder 451 disposed above the partition plate 453 and a second cylinder 452 disposed below the partition 453; the main bearing 421, the first cylinder 451, and the partition plate 453 define a first compression chamber 4511, while the partition plate 453, the second cylinder 452 and the auxiliary bearing 422 define a second compression chamber 4521.

Further, the compression mechanism also includes two pistons and two sliding vanes, each piston is disposed inside the corresponding compression chamber and capable of rolling along an inner wall of the compression chamber, and each sliding vane is movably disposed inside the corresponding sliding vane groove. A sliding vane groove, a gas suction hole and an exhaust hole are formed on each cylinder, in which the exhaust hole is directly or indirectly connected to the interior of the housing 2, and thereby connected to the exhaust port 21.

As shown in FIGS. 1 and 2, the two sliding vanes are represented by a first sliding vane 471 and a second vane 472, and the two pistons are represented by a first piston 461 and a second piston 462; a first sliding vane groove 4512, a first gas suction hole 4513 and a first exhaust hole 4514 are formed on the first cylinder 451; the first piston 461 is disposed inside the first compression chamber 4511 and rolls along the inner wall of the first compression chamber 4511; the first sliding vane groove 4512 can extend in a radial direction of the first cylinder 451, and the first sliding vane 471 is movably disposed inside the first sliding vane groove 4512 along a length direction thereof; a second sliding vane groove 4522, a second gas suction port 4523 and a second exhaust hole 4524 are formed on the second cylinder 452; the second piston 462 is disposed inside the second compression chamber 4521 and rolls along the inner wall of the second compression chamber 4521; the second sliding vane groove 4522 can extend in a radial of the second cylinder 452, and the second sliding vane 472 is movably disposed inside the second sliding vane groove 4522 along a length direction thereof.

The head portion of the sliding vane of one of the two cylinders abuts against an outer circumferential wall of the corresponding piston, while the sliding vane of the other one of the two cylinders can be optionally in contact with or separate from the corresponding piston. That is, there are two possibilities: first, when the head portion of the first sliding vane 471 of the first cylinder 451 abuts against the outer circumferential wall of the first piston 461, the sliding vane 472 of the second cylinders 452 can optionally contact or separate from the second piston 462; second, when the head portion of the second sliding vane 472 of the second cylinder 452 abuts against the outer circumferential wall of the second piston 462, the sliding vane 471 of the first cylinders 451 can optionally contact or separate from the first piston 461. Only the first possibility is exemplified below. Of course, those skilled in the art may apparently appreciate the second possible technical solution after reading the first possible technical solution below. Herein, it should be noted that the head portion of the sliding vane can be construed as an end of the sliding vane adjacent to the central axis of the corresponding compression chamber, and the opposite end thereof is the tail portion of the sliding vane which away from the central axis of the corresponding compression chamber.

Optionally, referring to FIG. 2, a spring 481 may be provided between the tail portion of the first sliding vane 471 and inner side wall of the housing 2, and keep pushing the head portion of the first sliding vane 471 to abut against to the outer circumferential wall of the first piston 461; a braking device 482 may be provided between the tail portion of the second sliding vane 472 and the inner side wall of the housing 2, and control the head portion of the second sliding vane 472 to abut against the outer circumferential wall of the second piston 462 under some working conditions and control the head portion of the second sliding vane 472 to separate from the outer circumferential wall of the second piston 462 under other working conditions. Herein, it should be noted that the devices capable of controlling the first sliding vane 471 and the second sliding vane 472 are not limited to the spring 481 and the sliding braking device 482. Additionally, it shall be noted that the sliding braking device 482 will be described in detail below, and thus will not be described herein.

On the compression mechanism, a first gas injection hole 441 is formed and configured to inject the refrigerant into the compression chamber of one of the cylinders (i.e. the cylinder provided with the sliding vane with its head portion abutting against the outer circumferential wall of the piston), and a second gas injection hole 442 is formed and configured to unidirectionally inject the refrigerant into the compression chamber of the other cylinder (i.e. the cylinder provided with the sliding vane optionally in contact with or separate from the corresponding piston). As shown in FIG. 2, the compression mechanism is provided with the first gas injection hole 441 for injecting the refrigerant into the first compression chamber 4511 of the first cylinder 451, and the second injection hole 442 for unidirectionally injecting the refrigerant into the second compression chamber 4512 of the second cylinder 452. Herein, the term "injecting unidirectionally" can be construed as that the refrigerant in the second compression chamber 4521 will not flow back to the second gas injection hole 442. In addition, it should be noted that the specific position of the specific configurations of the first gas injection hole 441 and the second gas injection hole 442 will be described in detail below, and thus will not be described herein.

Optionally, a one-way valve 443 may be provided to realize a check function. That is, the rotary compressor 700 further includes the one-way valve 443 disposed at the second gas injection hole 442 and configured to unidirectionally inject the refrigerant into the compression chamber of said another cylinder (i.e. the cylinder provided with the sliding vane optionally in contact with or separate from the corresponding piston). As shown in FIG. 2, the one-way valve 443 is disposed at the second gas injection hole 442 and configured to unidirectionally inject the refrigerant into the second compression chamber 4521 of the second cylinder 452, so as to prevent the refrigerant in the second compression chamber 4521 from flowing back to the second gas injection hole 442. Of course, the present disclosure is not limited thereby—other devices may be provided to realize the anti-backflow function.

Figure 3:
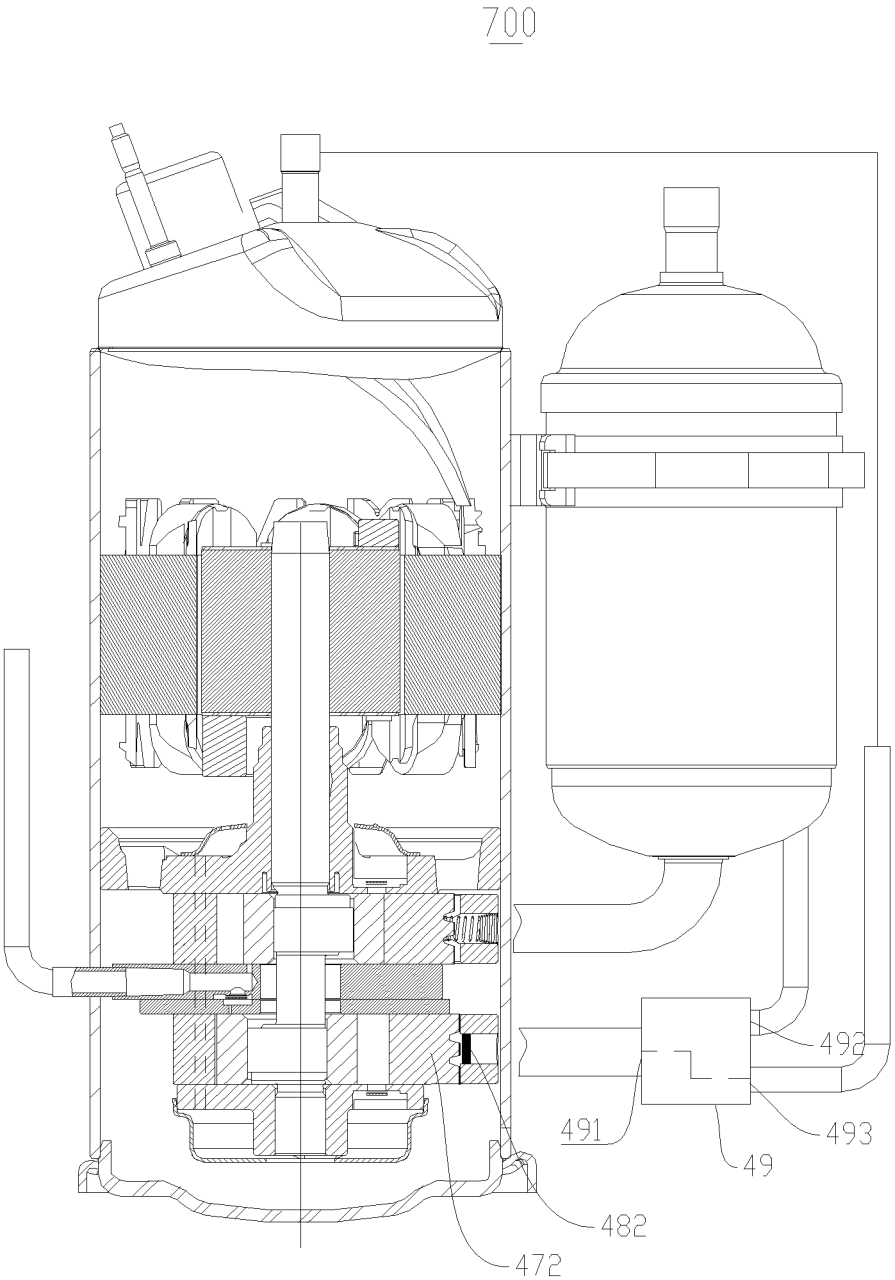
FIG. 3 shows a sectional view of the rotary compressor of FIG. 1 from another perspective, wherein the first valve port of the first direction control assembly is in communication with a third valve port thereof.

Further, referring to FIGS. 2 and 3, the first direction control assembly 49 includes a first valve port 491 connected to said another cylinder (i.e. the cylinder provided with the sliding vane optionally in contact with or separate from the corresponding piston), a second valve port 492 connected to the liquid reservoir 1, and a third valve port 493 in communication with the exhaust hole (i.e. the first exhaust hole 4514 or the second exhaust hole 4524), in which one of the second valve port 492 and the third port 493 is optionally in communication with the first valve port 491. That is, the second valve port 492 is in communication with the first valve port 491 under some working conditions (as shown in FIG. 2), while the third port 493 is in communication with the first valve port 491 under other working conditions (as shown in FIG. 3). Optionally, the first direction control assembly 49 is a three-way valve. Of course, the present disclosure is not limited thereby—the first direction control assembly 49 can also be configured as other structures capable of achieving the three-way switching effect.

Figure 6:
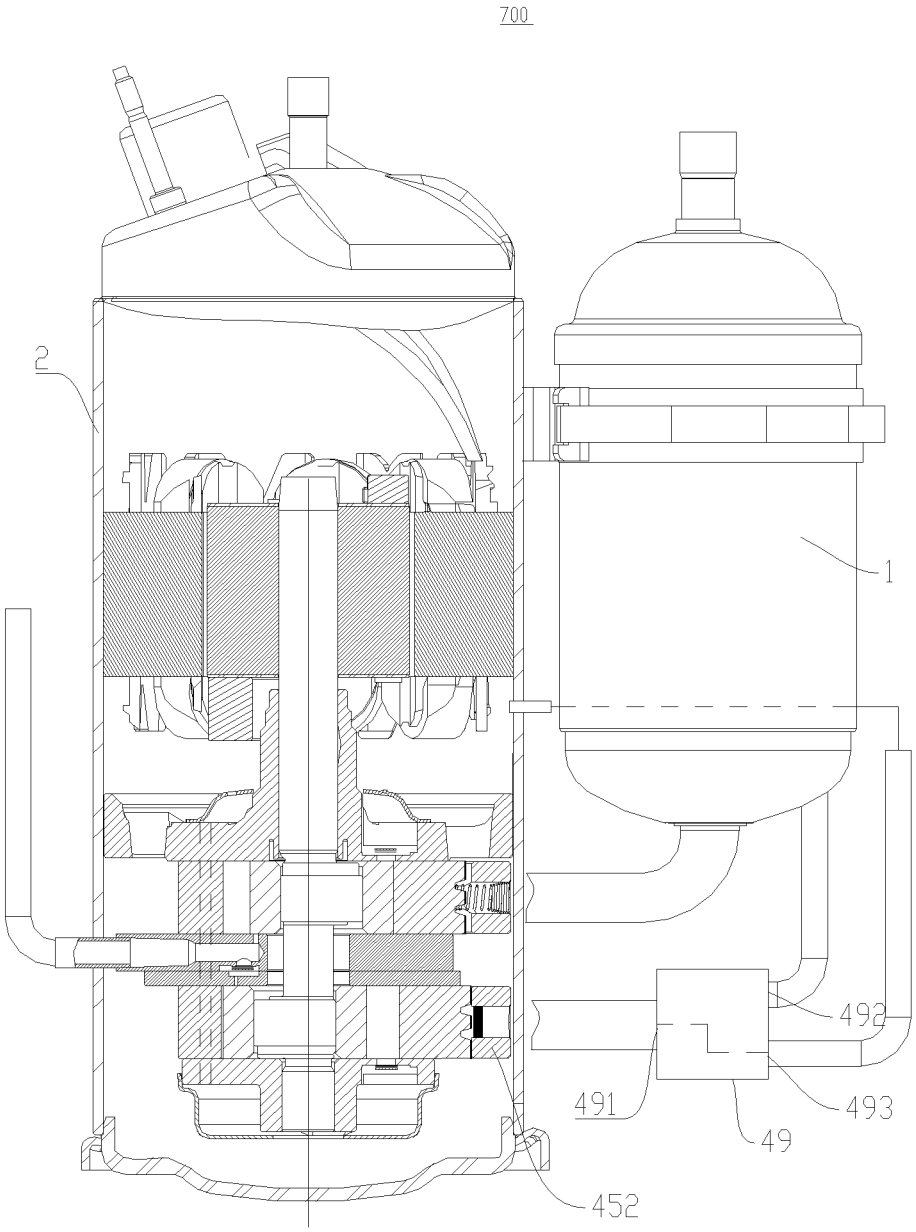
FIG. 6 shows a sectional view of a rotary compressor according to another embodiment of the present disclosure.

Herein, it should be noted that the third valve port 493 is in communication with the exhaust hole, and then may be in communication with the interior of the housing 2 and the exhaust port 21 since the exhaust hole is in communication with the interior of the housing 2 and the exhaust port 21. That is, the third valve port 493 can direct the exhaust pressure out of the exhaust pipe 22 or the sealed housing 2. As shown in FIGS. 1 to 3, the third valve port 493 is connected to the exhaust port 21, so as to be in communication with the exhaust hole. Alternatively, as shown in FIG. 6, the third valve port 493 is connected to the interior of the housing 2, so as to be in communication with the exhaust hole. Therefrom, it is convenient to process and implement.

As shown in FIGS. 1 to 3, the first gas suction 4513 of the first cylinder 451 is connected to and in communication with the liquid reservoir 1; the second gas suction port 4523 of the second cylinder 452 is connected to and in communication with the first valve port 491 of the first direction control assembly 49; the first exhaust hole 4514 of the first cylinder 451 is directly in communication with the interior of the housing 2, or indirectly in communication with that by a first muffler 431 described below, and the second exhaust hole 4524 of the second cylinder 452 is directly in communication with the interior of the housing 2, or indirectly in communication with that by a second muffler 432 described below, so that the first exhaust hole 4514 and the second exhaust hole 4524 can be in communication with the exhaust port 21 via the interior of the housing 2.

Referring to FIG. 2, the second valve port 492 of the first direction control assembly 49 is connected and communicated with the liquid reservoir 1, and when the second valve port 492 is in communication with the first valve port 491, the liquid reservoir 1 can deliver the refrigerant to the second compression chamber 4521 through the second gas suction port 4523. Referring to FIG. 3, the third valve port 493 of the first direction control assembly 49 is in communication with the first exhaust hole 4514 or the second exhaust hole 4524. That is, the third valve port 493 of the first direction control assembly 49 is in communication with the interior of the housing 2 and the exhaust port 21, so that when the third valve port 493 is in communication with the first valve port 491, the second gas suction port 4523 is in communication with the interior of the housing 2 and the exhaust port 21.

Thus, in the working process of the rotary compressor 700, two working modes can be achieved by switching between the two communication modes via the first direction control assembly 49, namely, a full load working mode and a part load working mode.

Specially, as shown in FIGS. 1 and 2, when the rotary compressor 700 adopts the full load working mode, the first direction control assembly 49 is configured to communicate the first valve port 491 with the second valve port 492, to communicate the second gas suction port 4523 of the second cylinder 452 with the liquid reservoir 1. Hereby, the low-pressure refrigerant with pressure Ps at the evaporation side of the refrigeration cycle device 1000 (which will be described hereinafter) flows through the liquid reservoir 1, into the first cylinder 451 via the first gas suction port 4513, and meanwhile, flows through the first direction control assembly 49 and the second gas suction port 4523, into the second cylinder 452, in which case the first cylinder 451 and the second cylinder 452 both work normally. The low-pressure refrigerant, flows into the interior of the sealed housing 2 respectively through the first exhaust hole 4514 and the second exhaust hole 4524, and is discharged from the exhaust pipe 22 at the exhaust port 21, after being compressed by the first cylinder 451 and the second cylinder 452 respectively, with the pressure increased to Pd, in which case the rotary compressor 700 is running in a double-cylinder manner and works in the full load working mode.

In the full load working mode, since the pressure at the second gas suction port 4523 is the low pressure Ps and the back pressure at the tail portion of the second sliding vane 472 is the high pressure Pd inside the sealed housing 2, the second sliding vane 472 is departed from the sliding braking device 482 (as shown in FIG. 2) under the action of the pressure difference, and the head portion of the second sliding vane 472 moves in contact with the outer circumferential wall of the second piston 462, so that the second cylinder 452 may work normally, in which case the enhanced vapor refrigerant with pressure Pm from the refrigeration cycle device 1000 may be injected into the first compression chamber 4511 via the first injection port 441, and meanwhile be unidirectionally injected into the second compression chamber 4521 via the second injection port 442, so as to achieve the double-cylinder injection operation of the rotary compressor 700.

Specially, as shown in FIGS. 1 and 3, when the rotary compressor 700 adopts the part load working mode, the first direction control assembly 49 is configured to communicate the first valve port 491 with the third valve port 493, so as to communicate the second gas suction port 4523 of the second cylinder 452 with the interior of the housing 2 and the exhaust port 21. Hereby, the low pressure refrigerant with pressure Ps from the evaporation side of the refrigeration cycle device 1000 enters the first cylinder 451 only via the first gas suction port 4513 after flowing through the liquid reservoir 1, and then the first cylinder 451 works normally. Since the second gas suction port 4523 is in communication with the interior of the housing 2 and the exhaust port 21, the interior of the second compression chamber 4521 has a high-pressure refrigerant, the pressure of the second gas suction port 4523 is the high pressure Pd, and meanwhile the back pressure at the tail portion of the second sliding vane 472 is the high pressure Pd inside the sealed housing 2, so that the sliding vane 472 is stopped in the second sliding vane groove 4522 (as shown in FIG. 3) under the action of the sliding vane braking device 482, due to the lack of enough pressure difference, and the head portion of the second sliding vane 472 is departed from the outer circumferential wall of the second piston 462, and thus the second cylinder 452 stops working, in which case the rotary compressor works in the part load working mode.

In the part load working mode, the enhanced vapor refrigerant with pressure Pm from the refrigeration cycle device 1000 is injected into the first compression chamber 4511 via the first injection port 441, and meanwhile, the high-pressure refrigerant with pressure Pd of the interior of the second compression chamber is stopped by the one-way valve 443 and thus cannot flow to the second gas injection hole 442, so as to achieve the single-cylinder injection operation of the rotary compressor 700.

The rotary compressor 700 according to embodiments of the present disclosure, can be the variable displacement enhanced vapor injection compressor, and can switch readily between the full load working mode and the part load working mode by providing the first direction control assembly 49 capable of switching between the two communication modes. Specially, the rotary compressor 700 can adopt the part load working mode when the load of the system is small, to make the system operate effectively, and when running in the full load working mode, the capacity of gas delivery of the rotary compressor 700 can be increased, so as to improve the heating effect in the low temperature heating application greatly. Thus the rotary compressor 700 can have a more reasonable structure, a higher operating efficiency, a wider range of applications, and a more excellent low temperature heating effect.

Hereinafter, the rotary compressor 700 according to some embodiments of the present disclosure is to be illustrated referring the FIGS. 1 to 6.

Referring to FIGS. 1 and 2, the rotary compressor 700 can includes a housing 2, an electric motor 3 and a compression mechanism disposed in the housing 2; the electric motor 3 is connected to the compression mechanism that includes a first cylinder 451 on the top of which a main bearing 421 is disposed, a second cylinder 452 at the bottom of which an auxiliary bearing 422 is disposed, and a partition plate 453 which can consist of a first partition plate 4531 and a second partition plate 4532.

Referring to FIGS. 1 and 2, the first cylinder 451 is formed with a first compression chamber 4511, and provided with a first piston 461 (rolling piston) rotating eccentrically in the first compression chamber 4511 of the first cylinder 451, and a first sliding vane 471 received in the first sliding vane groove 4512 and having a head portion (front end) in contact with the outer circumferential wall of the first piston 461 and a tail portion (rear end) provided with a spring 481.

Referring to FIGS. 1 and 2, the second cylinder 452 is formed a second compression chamber 4521, and provided with a second piston 462 (rolling piston) rotating eccentrically in the second compression chamber 4521 of the second cylinder 452, and a second sliding vane 472 received in the second sliding vane groove 4522 and having a head portion (front end) optionally in contact with or separate from the outer circumferential wall of the second piston 462 and a tail portion (rear end) provided with a spring 482.

Referring to FIGS. 1 and 2, the compression mechanism also includes a crankshaft 41 over which the first piston 461 and the second piston 462 are both fitted, so as to actuate the first piston 461 and the second piston 462 to roll at same time in the corresponding compression chambers by the crankshaft 41.

Referring to FIGS. 1 and 2, the first cylinder 451 is formed with a first gas suction port 4513 and a first exhaust hole 4514, and also provided with the a first gas suction pipe 11, one end of the first gas suction pipe 11 being connected to the first gas suction port 4513, and the other end thereof being connected to the liquid reservoir 1; the first exhaust hole 4514 is in communication with the interior of the housing 2 via the first exhaust valve 4211 of the main bearing 421 and the first muffler 431.

Referring to FIGS. 1 and 2, the second cylinder 452 is formed with a second gas suction port 4523 and a second exhaust hole 4524, and also provided with a second gas suction pipe 12, one end of the second gas suction pipe 12 being connected to the second gas suction port 4523, and the other end being optionally in communication with the liquid reservoir 1 and the exhaust port 21 (or the interior of the housing 2) via the direction control assembly 49 (for example a three-way valve); the second exhaust hole 4524 is in communication with the interior of the housing 2 via the second exhaust valve of the auxiliary bearing 422 and the second muffler 432.

Further, the partition plate 453 is formed with a first gas injection hole 441 in communication with the first compression chamber 4511, and a second gas injection hole 442 in communication with the second compression chamber 4521. That is, the first gas injection hole 441 and the second gas injection hole 442 can be formed in the partition plate 453. Hereby, as shown in FIG. 2, the rotary compressor 700 can also include the gas injection pipe 44; the first gas injection hole 441 and the second gas injection hole 442 are separately connected to the gas injection pipe 44, in which the one-way valve 443 is disposed between the second gas injection hole 442 and the gas injection pipe 44 and then gas can flow unidirectionally from the gas injection pipe 44 to the second gas injection hole 442 via the one-way valve 443, such that the first gas injection hole 441 and the second gas injection hole 442 can be periodically opened and closed following the rolling of the first piston 461 and the second piston 462 respectively. Therefrom, it is intended to facilitate the machining and the control over the opening and closing of the first gas injection hole 441 and the second gas injection hole 442.

Figure 4:
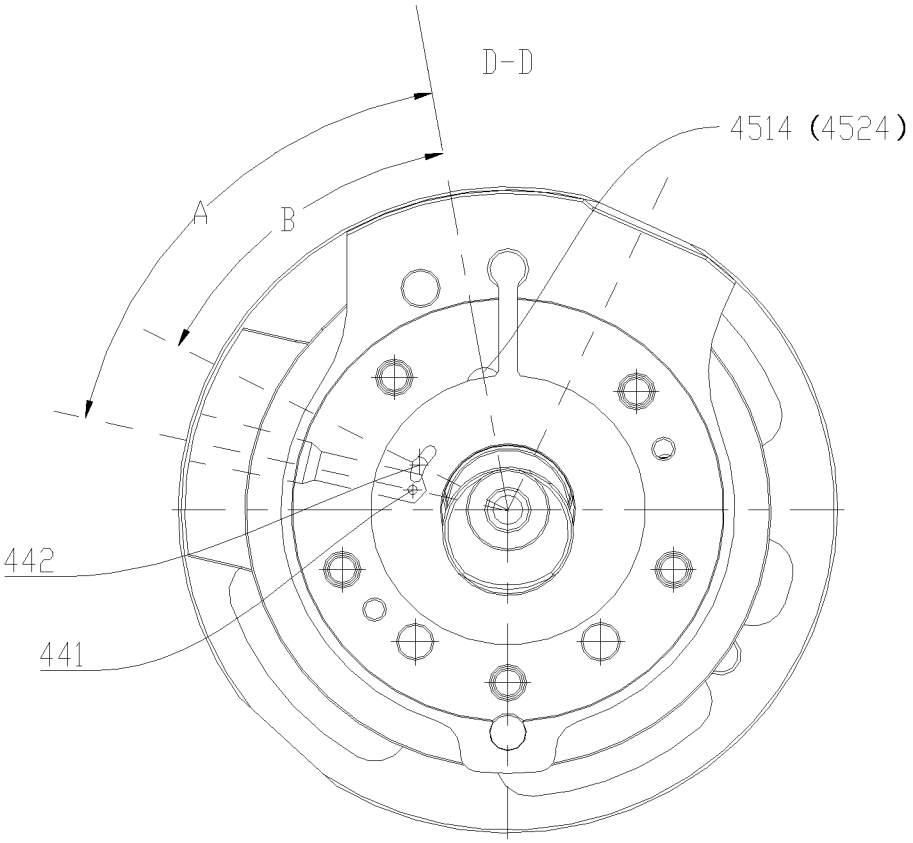
FIG. 4 shows a sectional view taken along line D-D of FIG. 2.

Since in the two working modes of the rotary compressor 700, the first cylinder 451 is always in the working state, that is, the first cylinder 451 is required to work when the load is small. When the load of the rotary compressor 700 is small, the injection termination time is earlier, the first gas injection hole 441 shall be closed earlier, but when the second cylinder 452 works at high load, the second gas injection hole 442 shall be closed later to increase the injection quantity. Therefrom, as shown in FIG. 4, the second gas injection hole 442 should be located at the side of the first gas injection hole 441 adjacent to the corresponding exhaust hole in the rolling direction of the piston (since the projection of the first exhaust hole 4514 and that of the second exhaust hole 4524 on a datum plane mentioned hereinafter coincide, it is reasonable to interpret the exhaust hole herein as either of the first exhaust hole 4514 and the second exhaust hole 4524). In other words, the second gas injection hole 442 is closer to the exhaust hole in the compressor rotating direction compared with the first gas injection hole 441. Therefrom, the rotary compressor 700 can switch better and more effectively between the two working modes of the full load working mode and the part load working mode, and can have the more reasonable structure, higher operating efficiency, wider application range, and more excellent low temperature heating effect.

As shown in FIG. 4, on the datum plane perpendicular to the center axis of the crankshaft 41, the projections of the first exhaust hole 4514 and the second exhaust hole 4524 coincide; the intersection point of the center axis of the crankshaft 41 and the datum plane is considered as the origin, so that the angle A, defined between the connection line from the midpoint of the projection of the first exhaust hole 4514 (or the second exhaust hole 4524) on the datum plane to the origin, and the connection line from the end point of the projection of the first gas injection hole 441 on the datum plane to the origin, can represent the angle of the first gas injection hole 441 with respect to the first exhaust hole 4514 (or the second exhaust hole 4524); the angle B, defined between the connection line from the midpoint of the projection of the first exhaust hole 4514 (or the second exhaust hole 4524) on the datum plane to the origin, and the connection line from the end point of the projection of the second gas injection hole 442 on the datum plane to the origin, can represent the angle of the second gas injection hole 442 with respect to the first exhaust hole 4514 (or the second exhaust hole 4524). The angle B is smaller than the angle A, so it can be construed as that the second injection port 442 is located at the side of the first gas injection hole 441 adjacent to the first exhaust hole 4514 (or the second exhaust hole 4524) in the rolling direction of the piston.

Figure 5:
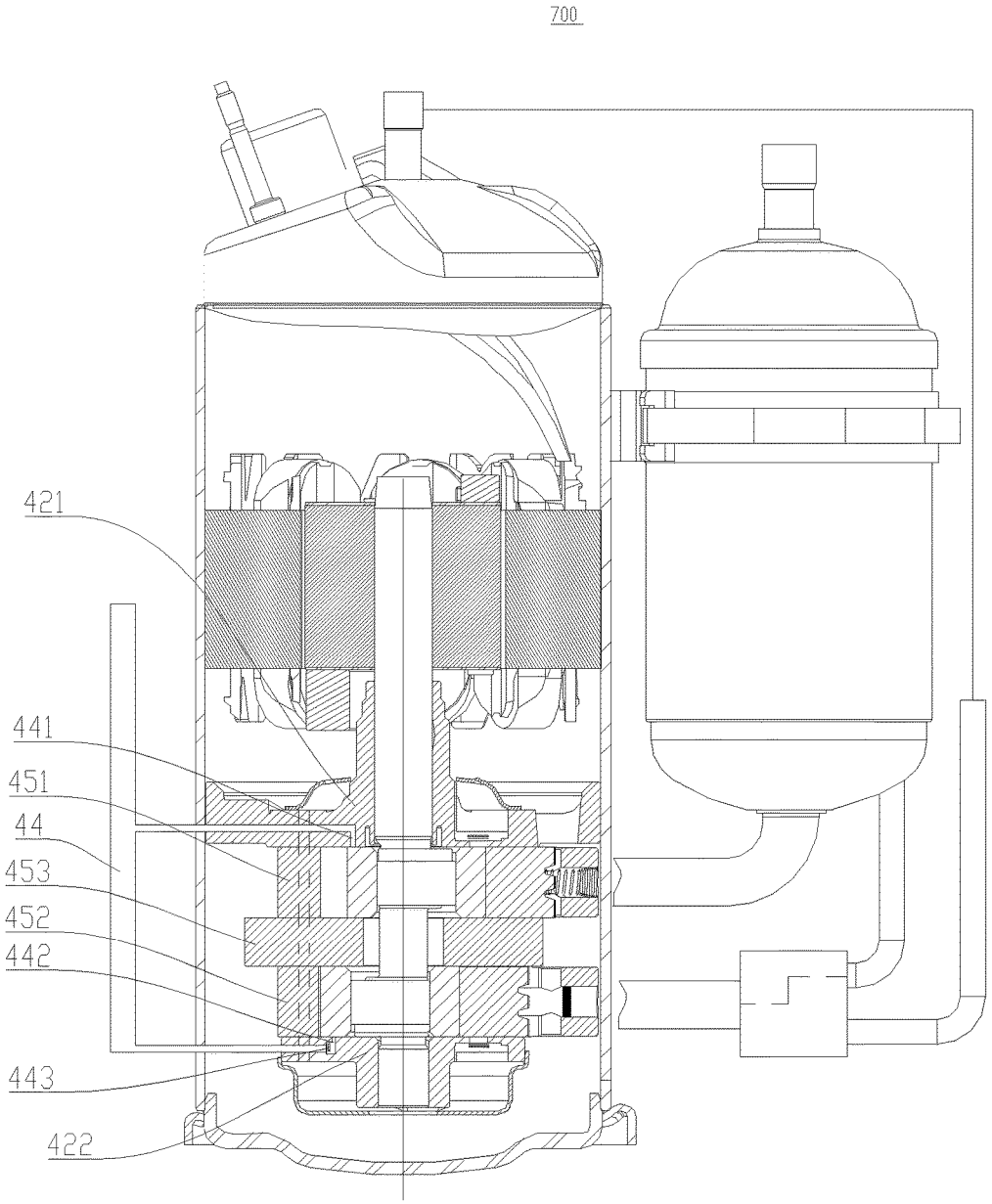
FIG. 5 shows a sectional view of a rotary compressor according to another embodiment of the present disclosure.

Of course, the present disclosure is not limited thereby—as shown in FIG. 5, the first gas injection hole 441 and the second gas injection hole 442 can also be formed in the main bearing 421 and the auxiliary bearing 422 respectively. That is, the first gas injection hole 441 is formed in the main bearing 421, and the second gas injection hole 442 is formed in the auxiliary bearing 422. Hereby, the first gas injection hole 441 and the second gas injection hole 442 can be periodically opened and closed following the rolling of the first piston 461 and the second piston 462 respectively. Similarly, as shown in FIG. 4, the second gas injection hole 442 is located at the side of the first gas injection hole 441 adjacent to the exhaust port in the rolling direction of the piston. That is, the second gas injection hole 442 is closer to the exhaust hole with respect to the first gas injection hole 441 in the rotating direction of the compressor. Therefrom, it is convenient to process and realize the control over the opening and closing of the first gas injection hole 441 and the second gas injection hole 442.

In an alternative embodiment of the present disclosure, the tail portion of the sliding vane of the said another cylinder (i.e. the cylinder provided with the sliding vane optionally in contact with or separate from the corresponding piston) is provided with the sliding braking device 482; when the pressure difference between the tail portion of the sliding vane and the head portion the sliding vane is larger than braking force acted on the sliding vane by the sliding vane braking device 482, the sliding vane is separated from the sliding vane braking device 482, and the head portion of the sliding vane is pressed against to the outer circumferential wall of the corresponding piston. Optionally, the braking force is from 2N to 10N. Therefrom, it is ensured that the rotary compressor 700 can reliably switch between the two working modes of the full load working mode and the part load working mode.

As shown in FIG. 2 and FIG. 3, the sliding braking device 482 can be a magnet, fixed in the second cylinder 452, and located between the rear end of the second sliding vane 472 and the inner side wall of the housing 2; the second sliding vane 472 slides in the second sliding vane groove 4522 due to the pressure difference between the rear end and the front end thereof. When the pressure difference between the rear end and front end of the second sliding vane 472 is greater than the braking force, the second sliding vane 472 can slide inwards to the second compression chamber 4521 to be separate from the sliding braking device 482, and the front end of the second sliding vane 472 abuts against the outer circumferential wall of the second piston 462 (as shown in FIG. 2). When the pressure difference between the rear end and front end of the second sliding vane 472 is smaller than or equal to the braking force, the sliding vane 472 is appressed with the sliding vane braking device 482 to keep relatively static with respect to the sliding vane braking device 482, so as to be separate from the outer circumferential wall of the second piston 462 (as shown in FIG. 3).

The refrigeration cycle device 1000 according to embodiments of the second aspect of the present disclosure, includes: the rotary compressor 700 according to embodiments of the first aspect of the present disclosure, a second direction control assembly 100 (for example a four-way reversing valve), an outdoor heat exchanger 200, an indoor heat exchanger 300, and a flash tank 400. Herein, it should be noted that the flash tank 400 can have a gas-liquid separation function which is generally well known by those skilled in the art and consequently will not be described in detail herein.

Figure 7:
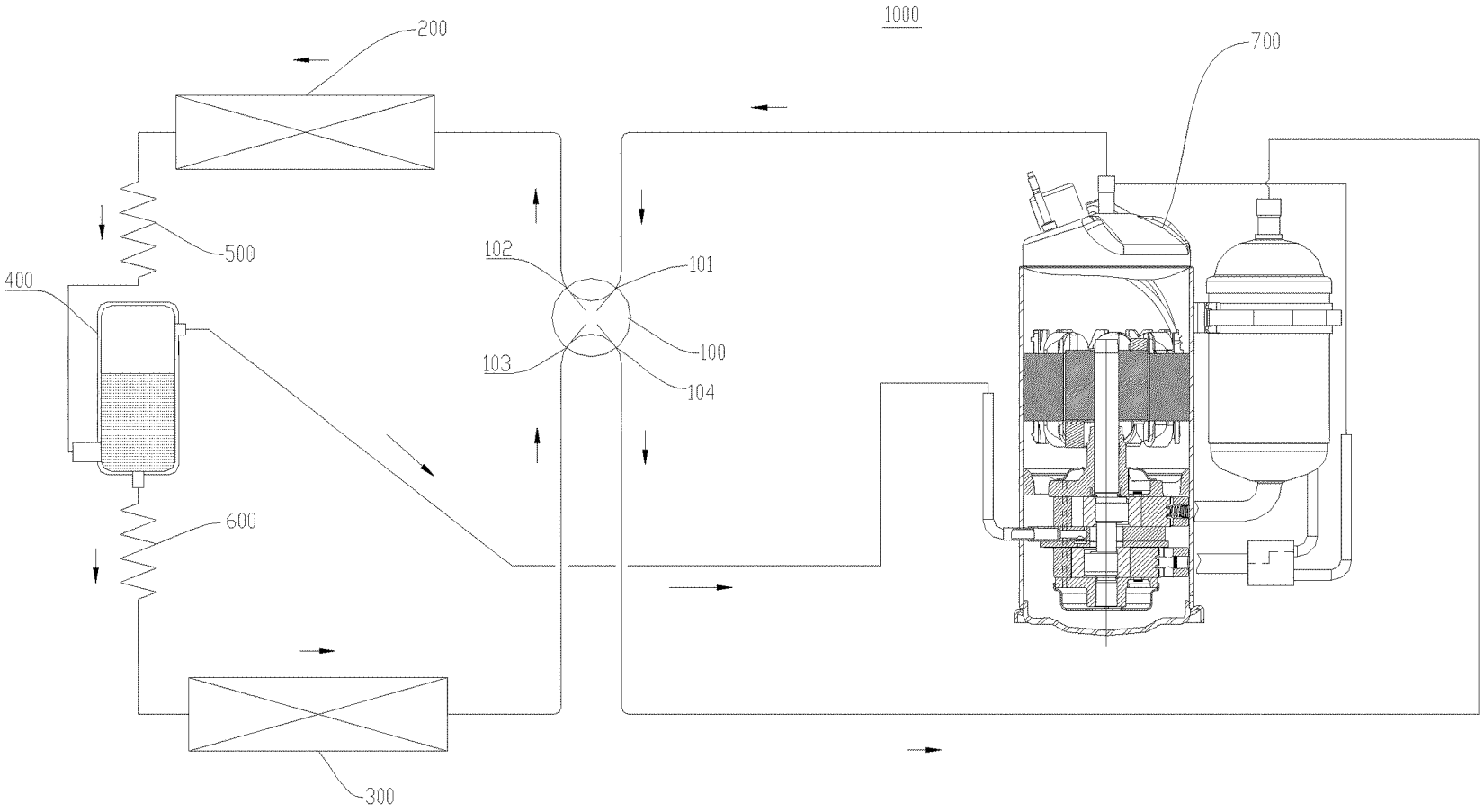
FIG. 7 shows schematic view of a system structure of a refrigeration cycle device according to an embodiment of the present disclosure.

Specially, as shown in FIG. 7, the second direction control assembly 100 includes a first connector 101 connected to the exhaust port 21 of the rotary compressor 700, a second connector 102, a third connector 103, and a fourth connector 104 connected to the liquid reservoir 1; a first end of the outdoor heat exchanger 200 is connected to the second connector 102, while a first end of the indoor exchanger 300 is connected to the third connector 103; a second end of the indoor exchanger 300 is connected to a second end of the outdoor exchanger 200; the flash tank 400 is connected between the second end of the indoor exchanger 300 and the second end of the outdoor exchanger 200, and connected to the first gas injection hole 441 and the second gas injection hole 442; in addition, a first throttling element 500 can be connected between the outdoor heat exchanger 200 and the flash tank 400, and a second throttling element 600 can be connected between the indoor heat exchanger 300 and the flash tank 400. Therefrom, it is possible to achieve the circulation of the refrigerant and enable the refrigeration cycle device 1000 to perform the refrigerating and heating work. The work principle of the refrigeration cycle device 1000 should be generally well known by those skilled in the art and thus will not be described in detail herein. In addition, the arrow direction in FIG. 7 illustrates the refrigerant flow direction when the refrigeration cycle device 1000 works in a certain working mode.

The refrigeration cycle device 1000 according to embodiments of the present disclosure has the higher operating efficiency and wider application range, by providing the rotary compressor 700 according to embodiments of the first aspect of the present disclosure.

In the specification, it is to be understood that terms such as "central," "upper," "lower," "front," "rear," "vertical," "horizontal," "top," "bottom," "inner," "outer," "radial," and "circumferential" should be construed to refer to the orientation as then described or as shown in the drawings under discussion. These relative terms are for convenience and simplification of description of the present disclosure, and do not alone indicate or imply that the device or element referred to must have a particular orientation, and must be constructed or operated in a particular orientation, thus it should not be construed to a limit to the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "one embodiment", "another example," "an example," "a specific example," or "some examples," means that a particular feature, structure, material, or characteristic described in connection with the embodiment or example is included in at least one embodiment or example of the present disclosure. Thus, the appearances of the phrases such as "in some embodiments," "in one embodiment", "in an embodiment", "in another example," "in an example," "in a specific example," or "in some examples," in various places throughout this specification are not necessarily referring to the same embodiment or example of the present disclosure. Furthermore, the particular features, structures, materials, or characteristics may be combined in any suitable manner in one or more embodiments or examples.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A rotary compressor comprising:

a liquid reservoir;

a housing disposed outside the liquid reservoir, wherein an exhaust port is formed in the housing;

a compression mechanism disposed within the housing, the compression mechanism comprising:

a cylinder assembly comprising:

a first cylinder in which a first compression chamber, a first sliding vane groove, a first air suction hole and a first exhaust hole are formed;

a second cylinder in which a second compression chamber, a second sliding vane groove, a second air suction hole and a second exhaust hole are formed;

a partition plate arranged between the first cylinder and the second cylinder;

a first piston disposed inside the first compression chamber, wherein the first piston is configured to roll along an inner wall of the first compression chamber;

a second piston disposed inside the second compression chamber, wherein the second piston is configured to roll along an inner wall of the second compression chamber;

a first sliding vane movably disposed inside the first sliding vane groove, wherein a head portion of the first sliding vane is urged to abut against an outer circumferential wall of the first piston;

a second sliding vane movably disposed inside the second sliding vane groove, wherein the second sliding vane groove is configured to:

in a first mode, be urged to abut against an outer circumferential wall of the second piston; and in a second mode, be separated from the second piston;

wherein the compression mechanism is provided with:

a first gas injection hole for injecting a refrigerant into the first compression chamber of the first cylinder in both the first mode and the second mode; and a second gas injection hole for unidirectionally injecting the refrigerant into the second compression chamber of the second cylinder in the first mode and not in the second mode; and a first direction control assembly comprising:

a first valve port connected to the second air suction hole of the second cylinder;

a second valve port connected to the liquid reservoir; and a third valve port in communication with one of the first exhaust hole and the second exhaust hole, wherein the first valve port is configured to:

in the first mode, be in communication with the second valve port; and in the second mode, be in communication with the third valve port.

2. The rotary compressor according to claim 1, wherein the first gas injection hole and the second gas injection hole are formed in the partition plate.

3. The rotary compressor according to claim 1, wherein the cylinder assembly comprises:

a main bearing disposed at a first axial end of the cylinder assembly; and an auxiliary bearing disposed at a second axial end of the cylinder assembly, and wherein the first gas injection hole is formed in the main bearing and the second gas injection hole is formed in the auxiliary bearing.

4. The rotary compressor according to claim 1, wherein the second gas injection hole is located at a side of the first gas injection hole adjacent to the first exhaust hole or the second exhaust hole in the rolling direction of the first piston or the second piston.

5. The rotary compressor according to claim 1, further comprising:

a one-way valve disposed at the second gas injection hole, wherein the one-way valve is configured to unidirectionally inject the refrigerant into the second compression chamber of the second cylinder.

6. The rotary compressor according to claim 1, further comprising:

a sliding vane brake is provided at a tail portion of the second sliding vane, wherein in response to the difference between the pressure at the tail portion of the second sliding vane and the pressure at a head portion of the second sliding vane is larger than a force acted on the second sliding vane by the sliding vane brake, the second sliding vane is configured to separate from the sliding vane brake to urge the head portion of the second sliding vane to abut against the outer circumferential wall of the second piston.

7. The rotary compressor according to claim 6, wherein the braking force ranges from 2N to 10N.

8. The rotary compressor according to claim 1, wherein the third valve port is directly connected to the exhaust port or an interior of the housing.

9. The rotary compressor according to claim 1, wherein the first direction control assembly comprises a three-way valve.

10. A refrigeration cycle device comprising:

a rotary compressor comprising:

a liquid reservoir;

a housing disposed outside the liquid reservoir, wherein an exhaust port is formed in the housing;

a compression mechanism disposed within the housing, the compression mechanism comprising:

a cylinder assembly comprising:

a first cylinder in which a first compression chamber, a first sliding vane groove, a first air suction hole and a first exhaust hole are formed;

a second cylinder in which a second compression chamber, a second sliding vane groove, a second air suction hole and a second exhaust hole are formed;

a partition plate arranged between the first cylinder and the second cylinder;

a first piston disposed inside the first compression chamber, wherein the first piston is configured to roll along an inner wall of the first compression chamber;

a second piston disposed inside the second compression chamber, wherein the second piston is configured to roll along an inner wall of the second compression chamber;

a first sliding vane movably disposed inside the first sliding vane groove, wherein a head portion of the first sliding vane is urged to abut against an outer circumferential wall of the first piston;

a second sliding vane movably disposed inside the second sliding vane groove, wherein the second sliding vane groove is configured to:

in a first mode, be urged to abut against an outer circumferential wall of the second piston; and in a second mode, be separated from the second piston;

wherein the compression mechanism is provided with:

a first gas injection hole for injecting a refrigerant into the first compression chamber of the first cylinder in both the first mode and the second mode; and a second gas injection hole for unidirectionally injecting the refrigerant into the second compression chamber of the second cylinder in the first mode and not in the second mode; and a first direction control assembly comprising:

a first valve port connected to the second air suction hole of the second cylinder;

a second valve port connected to the liquid reservoir; and a third valve port in communication with one of the first exhaust hole and the second exhaust hole, wherein the first valve port is configured to:

in the first mode, be in communication with the second valve port; and in the second mode, be in communication with the third valve port; and;

a second direction control assembly comprising a first connector, a second connector, a third connector and a fourth connector, wherein the first connector is connected to the exhaust port of the rotary compressor, and wherein the fourth connector is connected to the liquid reservoir;

an outdoor heat exchanger having a first end connected to the second connector;

an indoor heat exchanger having a first end connected to the third connector and a second end connected to a second end of the outdoor heat exchanger; and a flash tank connected between the second end of the indoor heat exchanger and the second end of the outdoor heat exchanger, wherein the flash tank is connected to the first gas injection hole and the second gas injection hole of the rotary compressor.

11. The refrigeration cycle device according to claim 10, wherein the first gas injection hole and the second gas injection hole are formed in the partition plate.

12. The refrigeration cycle device according to claim 10, wherein the cylinder assembly comprises:

a main bearing disposed at a first axial end of the cylinder assembly; and an auxiliary bearing disposed at a second axial end of the cylinder assembly, and wherein the first gas injection hole is formed in the main bearing and the second gas injection hole is formed in the auxiliary bearing.

13. The refrigeration cycle device according to claim 10, wherein the second gas injection hole is located at a side of the first gas injection hole adjacent to the first exhaust hole or the second exhaust hole in the rolling direction of the first piston or the second piston.

14. The refrigeration cycle device according to claim 10, further comprising:

a one-way valve disposed at the second gas injection hole, wherein the one-way valve is configured to unidirectionally inject the refrigerant into the second compression chamber of the second cylinder.

15. The refrigeration cycle device according to claim 10, further comprising:

a sliding vane brake provided at a tail portion of the second sliding vane, wherein in response to the difference between the pressure at the tail portion of the second sliding vane and the pressure at a head portion of the second sliding vane is larger than a braking force acted on the second sliding vane by the sliding vane brake, the second sliding vane is configured to separate from the sliding vane brake to urge the head portion of the second sliding vane to abut against the outer circumferential wall of the second piston.

16. The refrigeration cycle device according to claim 15, wherein the braking force ranges from 2N to 10N.

17. The refrigeration cycle device according to claim 10, wherein the third valve port is directly connected to the exhaust port or an interior of the housing.

18. The refrigeration cycle device according to claim 10, wherein the first direction control assembly comprises a three-way valve.

* * * * *